United States Patent [19]

Dobler et al.

[11] 3,969,048

[45] July 13, 1976

[54] ROTARY PISTON INTERNAL COMBUSTION ENGINE OF TROCHOIDAL CONSTRUCTION

[75] Inventors: Helmut Dobler, Esslingen; Kurt Nadolny, Erdmannhausen; Karl Zeilinger, Endersbach; Heinz Lamm, Esslingen-St. Bernhardt; Horst Piry, Deizisau, all of Germany

[73] Assignee: Daimler-Benz Aktiengesellschaft, Stuttgart, Germany

[22] Filed: May 15, 1974

[21] Appl. No.: 470,278

[30] Foreign Application Priority Data

May 18, 1973 Germany ..... 2325249

[52] U.S. Cl. ..... 418/83; 165/147

[51] Int. Cl.[2] ..... F01C 21/06

[58] Field of Search ..... 418/61 A, 83; 123/8.01; 165/147

[56] References Cited

UNITED STATES PATENTS

| | | | |
|---|---|---|---|
| 2,875,985 | 3/1959 | Hold | 165/147 |
| 3,007,460 | 11/1961 | Bentele et al. | 418/61 A |
| 3,102,516 | 9/1963 | Gist et al. | 418/83 |
| 3,286,700 | 11/1966 | Froede | 123/8.01 |
| 3,298,330 | 1/1967 | Ito et al. | 123/8.01 |
| 3,313,276 | 4/1967 | Ito et al. | 418/61 A |
| 3,323,501 | 6/1967 | Balve | 418/83 |
| 3,644,070 | 2/1972 | Lermusiax | 418/83 |
| 3,691,999 | 9/1972 | Lechler | 418/83 |

*Primary Examiner*—C. J. Husar
*Attorney, Agent, or Firm*—Craig and Antonelli

[57] ABSTRACT

A rotary piston internal combustion engine of trochoidal construction which includes a housing casing with hollow spaces for a cooling media disposed between housing inner and housing outer walls, whose outer wall is provided with a cooling medium channel; a polygonal piston rotates within the housing casing and slides along its inner wall, and at least one cooling medium bore constructed as nozzle is provided which branches off from the cooling medium channel, is arranged in the housing outer wall and is directed toward the hottest area of the housing inner wall.

7 Claims, 1 Drawing Figure

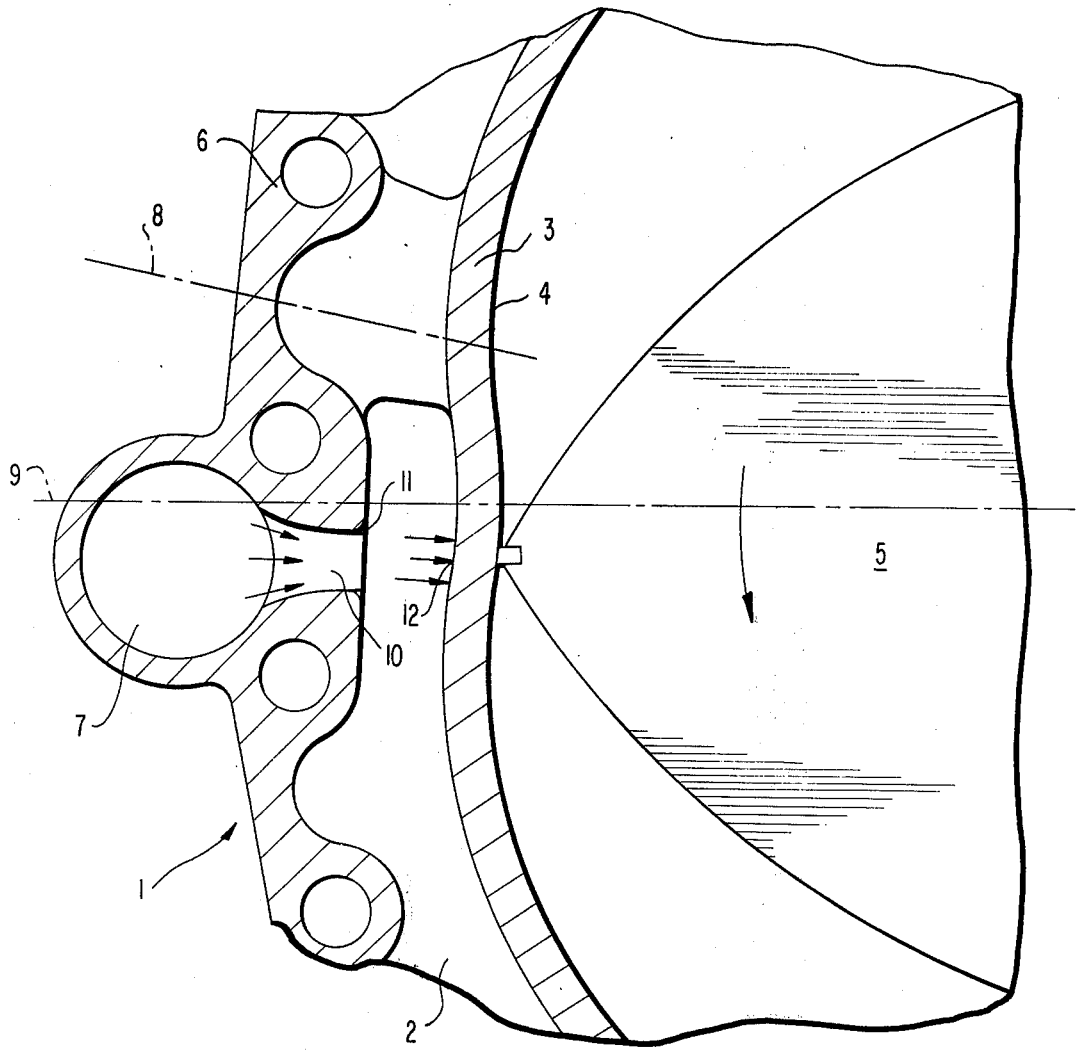
6
8
3
4
9
11
5
12
10
7
1
2

ROTARY PISTON INTERNAL COMBUSTION ENGINE OF TROCHOIDAL CONSTRUCTION

The present invention relates to a rotary piston internal combustion engine of trochoidal construction, essentially consisting of a housing casing with hollow spaces disposed between housing inner and housing outer walls for cooling media, whose outer wall includes a cooling medium channel and a polygonal piston rotating within the housing casing and sliding along the inner wall thereof.

With housing casings of known rotary piston internal combustion engines, the cooling is achieved by cooling media which flow through cooling-medium hollow spaces and/or cooling medium channels in the circumferential direction of the trochoid or transversely thereto, i.e., in the axial direction of the internal combustion engine.

Since these constructions demonstrated an inadequate cooling especially with highly loaded internal combustion engines, it is the aim of the present invention to avoid this disadvantage and to achieve a considerably more effective cooling by means of slight structural expenditures.

The underlying problems are solved according to the present invention in that at least one cooling medium bore constructed as nozzle and branching off from the cooling medium channel is arranged in the housing outer wall, which is directed toward the hottest place of the inner wall of the housing casing.

In a preferred embodiment according to the present invention, the cooling medium bore may be directed perpendicularly or approximately perpendicularly toward the place of the inner wall.

According to a further feature of the present invention, the cooling medium bore may be constructed conically and may have the narrowest cross section at the cooling medium discharge.

The arrangement according to the present invention brings about that as a result of the radial cooling medium entry or admission — the cooling medium impinges with a high velocity against the hottest places at the inner wall of the housing casing or at least in proximity thereof by reason of the cooling medium bore constructed as nozzle — the temperatures at this location are considerably reduced. In addition to a lower peak temperature, additionally also a more uniform temperature distribution over the circumference of the trochoid and therewith a more uniform thermal expansion is achieved which is of advantage in particular for the operation and function of the sealing elements. Furthermore, the impinging cooling medium, as a result of its high velocity has the capability to detach vapor bubbles and thus to rapidly conduct away the heat out of the central area where the heat is produced.

Accordingly, it is an object of the present invention to provide a rotary piston internal combustion engine of trochoidal construction which avoids by simple means the aforementioned shortcomings and drawbacks encountered in the prior art.

Another object of the present invention resides in a rotary piston internal combustion engine of trochoidal construction which assures a completely adequate cooling, even under high engine loads, yet requires no great structural expenditures.

A further object of the present invention resides in a rotary piston internal combustion engine which excels by a more effective cooling, enabling a reduction of temperature peaks and a more uniform temperature distribution over the circumference of the trochoid.

Still a further object of the present invention resides in a rotary piston internal combustion engine in which the sealing elements are capable to function more effectively due to a greater uniformity of the thermal expansion of the various parts.

Another object of the present invention resides in a rotary piston internal combustion engine in which the reduced heat is rapidly removed and the formation of vapor bubbles is avoided.

These and other objects, features and advantages of the present invention will become more apparent from the following description when taken in connection with the accompanying drawing which shows, for purposes of illustration only, one embodiment in accordance with the present invention, and wherein:

The single FIGURE is a partial cross-sectional view through one embodiment of a rotary piston internal combustion engine provided with a cooling system in accordance with the present invention.

Referring now to the single FIGURE of the drawing, a two-arched housing casing generally designated by reference numeral 1 of a rotary piston internal combustion engine is provided with hollow spaces 2 provided for cooling media, which are delimited, on the one hand, by a housing inner wall 3, along the casing contact surface 4 of which slides a triangularly constructed piston 5, and, on the other, by a housing outer wall 6.

The cooling medium channel 7 extending parallel to the longitudinal axis of the internal combustion engine is arranged in the housing outer wall 6. A cooling medium bore 10 operable as nozzle branches off from the cooling medium channel 7 within the spark plug area — the position of the spark plug is indicated schematically by the dash and dot line 8 — in close proximity to the rear of the minor axis 9, as viewed in the direction of rotation of the piston 5 indicated by the arrow. The cooling medium bore 10 is constructed conically and has its narrowest cross section at the cooling medium discharge 11.

The axis of the cooling medium bore 10 is directed toward the hottest place or area 12 of the inner wall 3 of the housing casing 1.

A part of the cooling medium conducted through the cooling medium channel 7 flows through the nozzle 10 and as a result of the constriction impinges with a high velocity against the thermally highest stressed portion of the inner wall 3 by way of the hollow space 2 and brings about a considerable reduction of the temperatures prevailing thereat as a result of the intentional and rapid cooling, which means a more uniform temperature distribution connected with a more uniform thermal expansion and furthermore avoidance of the formation of vapor bubbles.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are emcompassed by the scope of the appended claims.

We claim:

1. A rotary piston internal combustion engine of trochoidal construction, which includes a housing casing means, provided with hollow space means disposed between the housing inner and housing outer wall means for a cooling medium, the outer wall means including a cooling medium channel means, and a polygonal piston means rotating within the housing casing means and sliding along the inner wall means, characterized in that at least one cooling medium bore means in communication with the cooling medium channel means, is arranged in the housing outer wall means, the cooling medium bore means being directed toward the hottest area of the housing inner wall means, the cooling medium bore means being constructed as a conically shaped nozzle having its narrowest cross-section at the end thereof opening into said hollow space means, whereby said cooling medium is discharged from said medium bore means so as to impinge at said hottest area of the housing inner wall means at a high velocity.

2. A rotary piston internal combustion engine according to claim 1, characterized in that the cooling medium bore means branches off directly from the cooling medium channel means.

3. A rotary piston internal combustion engine according to claim 2, characterized in that the cooling medium bore means is directed perpendicularly toward said hottest area of the inner wall means.

4. A rotary piston internal combustion engine according to claim 3, wherein said cooling medium channel means and said housing inner and outer wall means all constitute portions of said housing casing means, wherein said cooling medium channel means extends parallel to the axis of rotation of said piston means, and wherein said cooling medium bore means extends radially of said axis.

5. A rotary piston internal combustion engine according to claim 1, characterized in that the cooling medium bore means is directed perpendicularly toward said hottest area of the inner wall means.

6. A rotary piston internal combustion engine according to claim 1, wherein said cooling medium channel means extends parallel to the axis of rotation of said piston means, and wherein said cooling medium bore means extends radially of said axis.

7. A rotary piston internal combustion engine according to claim 1, wherein said cooling medium channel means and said housing inner and outer wall means all constitute portions of said housing casing means, wherein said cooling medium channel means extends parallel to the axis of rotation of said piston means, and wherein said cooling medium bore means extends radially of said axis.

* * * * *